US005199597A

United States Patent [19]

Gladish

[11] Patent Number: 5,199,597

[45] Date of Patent: Apr. 6, 1993

[54] SELF-CLOSING CONTAINER LID

[76] Inventor: William C. Gladish, 6501 Harding Rd. Apt. A24, Nashville, Tenn. 37205

[21] Appl. No.: 753,221

[22] Filed: Aug. 30, 1991

[51] Int. Cl.[5] ..... A47G 19/22

[52] U.S. Cl. ..... 200/715; 220/714; 220/254; 220/348; 220/345; 222/559

[58] Field of Search ..... 220/348, 345, 254, 262, 220/263, 264, 253, 714, 715; 215/303, 304; 222/556, 559, 558, 509

[56] References Cited

U.S. PATENT DOCUMENTS

| | | | |
|---|---|---|---|
| 614,579 | 11/1898 | Schiller | 215/304 |
| 2,253,177 | 8/1941 | Hacmac | 222/559 X |
| 2,327,618 | 8/1943 | Bernhardt | 222/559 X |
| 2,516,513 | 7/1950 | Gall, Jr. | 222/559 X |
| 2,574,338 | 11/1951 | Lewis | 222/559 X |
| 2,652,177 | 9/1953 | Lagemann | 222/559 X |
| 2,718,338 | 9/1955 | Cicero | 222/559 X |
| 2,751,130 | 6/1956 | Murphy | 222/509 |
| 2,884,157 | 4/1959 | Lampkin | 220/711 X |
| 2,935,291 | 5/1960 | Stelzer | 222/558 X |
| 3,840,159 | 10/1974 | Downey | 222/509 |
| 3,938,690 | 2/1976 | Butler | 220/90.4 |
| 4,057,167 | 11/1977 | Lee | 220/90.4 |
| 4,212,408 | 7/1980 | Valenzona . | |
| 4,257,537 | 3/1981 | Uhlig | 220/345 X |
| 4,276,992 | 7/1981 | Susich . | |
| 4,303,173 | 12/1981 | Nergard | 220/90.4 X |
| 4,561,560 | 12/1985 | Lyon | 220/345 X |
| 4,673,813 | 6/1987 | Sanchez . | |
| 4,790,444 | 12/1988 | Terzi | 220/714 |

FOREIGN PATENT DOCUMENTS

| | | | |
|---|---|---|---|
| 3438677 | 4/1986 | Fed. Rep. of Germany . | |
| 1078213 | 11/1954 | France | 220/254 |

*Primary Examiner*—Allan N. Shoap
*Assistant Examiner*—Paul A. Schwarz
*Attorney, Agent, or Firm*—James M. Ritchey

[57] ABSTRACT

Disclosed is a removable self-closing lid for covering a top of a container, wherein the container has an outer wall surface and a top with an opening for accessing into the container. The lid includes a cap, a pressure fitting and sealing perimeter lip for securing the cap over the container top, and a pouring aperture. Further included in the lid is an automatic leveraging mechanism which is activated by a user exerting pressure on a trigger, thereby opening the pouring aperture. The pouring aperture is automatically sealed when the leveraging means is deactivated by the user releasing the pressure on the trigger. Incorporated into the trigger is a leverage ridge that provides a fulcrum that slides over the container's outer wall surface during activation and deactivation.

6 Claims, 12 Drawing Sheets

SELF-CLOSING CONTAINER LID

BACKGROUND OF THE INVENTION

1. Field of the Invention

The subject invention relates to an automatically sealing container lid. Usually, the container holds a liquid beverage. Once a user either intentionally or accidentally releases a means for accessing, via a pouring aperture in the lid, the contents of the lid covered container, a resilient means associated with the lid closes the pouring aperture to prevent spillage or contamination of the beverage.

2. Description of the Background Art

Numerous types of covers exist for sealing user consumable liquids within a housing vessel. One grouping of such covers is employed to temporarily seal a container and then permit limited access for drinking or pouring. A general example is presented in the traditional automatically closing syrup or honey container found in many restaurants. Typically, with the syrup device a threaded lid is mated with the threaded mouth of a container. Generally, the lid comprises a central body having a resealable opening for accessing the syrup, a slidable member associated with the body for closing the opening, a handle projecting from the central body, and a handle associated trigger or similar element that is forced by a user towards the handle to move the slidable member into the open position. Usually, when the user is finished pouring the syrup through the opening, the trigger is released and a spring forces the slidable member over the opening. Key to the syrup type resealable lid is the action of the trigger-to-handle compression required to access the opening.

More specifically, U.S. Pat. No. 3,938,690 discloses a spill-proof drinking container. The container comprises a lid having a slidable member mounted in receiving tracks or a guide device. Springs secured to the slidable member force the member closed to seal a drinking opening.

A valved receptacle closure is related in U.S. Pat. No. 4,057,167. Supplied is a container lid having a sealable perimeter, an access opening, and a valve for accessing the opening. A latch is incorporated into the valve to releasably secure the valve in an open configuration. A resilient means is provided to assist in closing the valve over an access opening.

Presented in U.S. Pat. No. 4,212,408 is a beverage drinking container. Specifically, an improved lid is provides having an access opening and a trigger activated closure plug for sealing the opening. Upon depressing the trigger the plug is hinged to withdraw from the opening, thereby accessing the contents of the container.

U.S. Pat. No. 4,257,537 details a child resistant flour-sifter type closure or lid. The lid includes a hinged locking flap that pivots open to allow access to the contents of the vessel and pivots shut to limit access. Compression of the outer rim of the lid releases the locking flap.

A drinking cup with a laterally actuated valve is described in U.S. Pat. No. 4,276,992. A lid having a resealable access opening and means for accessing the opening is secured to a container. A member having an access opening plug is hinged to the underside of the lid. The hinged member is withdrawn from a sealing position within the access opening by depressing a finger trigger associated with the lid and hinged member.

Disclosed within U.S. Pat. No. 4,561,560 is a liquid container holder having sliding closure means. A can or carton container of liquid that once opened is not self-resealable is placed within the holder. A container piercing member is hinged into place over the container to puncture the container. Included in the hinged member is a sliding means for accessing the enclosed liquid.

U.S. Pat. No. 4,673,813 presents a multi-dose radioisotope container. A sliding access means is incorporated into a lid whereby a spring retaining stud holds a sliding member in an open position for accessing the container.

Within German Patent No. 3,438,677 is explained a pouring spout for a liquid container wherein the pouring spout has a plunger type sealing member. Depression of the plunger accesses the contents of the container.

SUMMARY OF THE INVENTION

An object of the present invention is to provide an automatically sealing lid for covering a container.

A further object of the present invention is to furnish a removable container lid that is opened to access the container by a user applying pressure to a leveraging mechanism and is closed by removing the pressure.

Another object of the present invention is to create a removable container lid that employs the container's side wall as a supporting contact surface for a sliding fulcrum incorporated into the lid.

An additional object of the present invention is to generate a removable liquid beverage can lid having a guide member that assists the user in quickly aligning the lid's pouring aperture over the container's access opening.

Yet one more object of the present invention is to present a removable liquid container lid that permits a user ready access to the contents of the container yet remains sealed against substantial loss of the container's liquid if the container is accidently dropped or tipped over.

Yet a further object of the present invention is to provide a removable liquid container lid that prevents contamination of the liquid when access to the liquid is not desired.

Yet an additional object of the present invention is to produce a removable liquid container lid that aids both in prolonging the temperature of the liquid within the container and in maintaining carbonation levels within the liquid.

Disclosed is a removable self-closing lid for covering a top of a container, wherein the container has an outer wall surface and the container top has an opening for accessing into the container. The lid comprises a cap member having upper and lower surfaces, a pressure fitting and sealing perimeter lip for securing the cap member over the container top (the cap member lip is slightly resilient to stretch over the container top), and a pouring aperture penetrating through the cap upper and lower surfaces. Additionally, included is a leveraging means associated with the cap for accessing the container through the pouring aperture when the leveraging means is activated by a user exerting pressure on the leveraging means. The leveraging means automatically seals the container when the leveraging means is deactivated by the user releasing the pressure. The leveraging means contacts the outer container wall surface via a leveraging ridge. During activation and deactivation of the leveraging means, to open and close the pouring aperture, respectively, the leveraging ridge moves over the container's outer wall surface, thereby providing a sliding fulcrum.

Other objects, advantages, and novel features of the present invention will become apparent from the detailed description that follows, when considered in conjunction with the associated drawings.

DESCRIPTION OF THE PREFERRED EMBODIMENT

Figure 1:
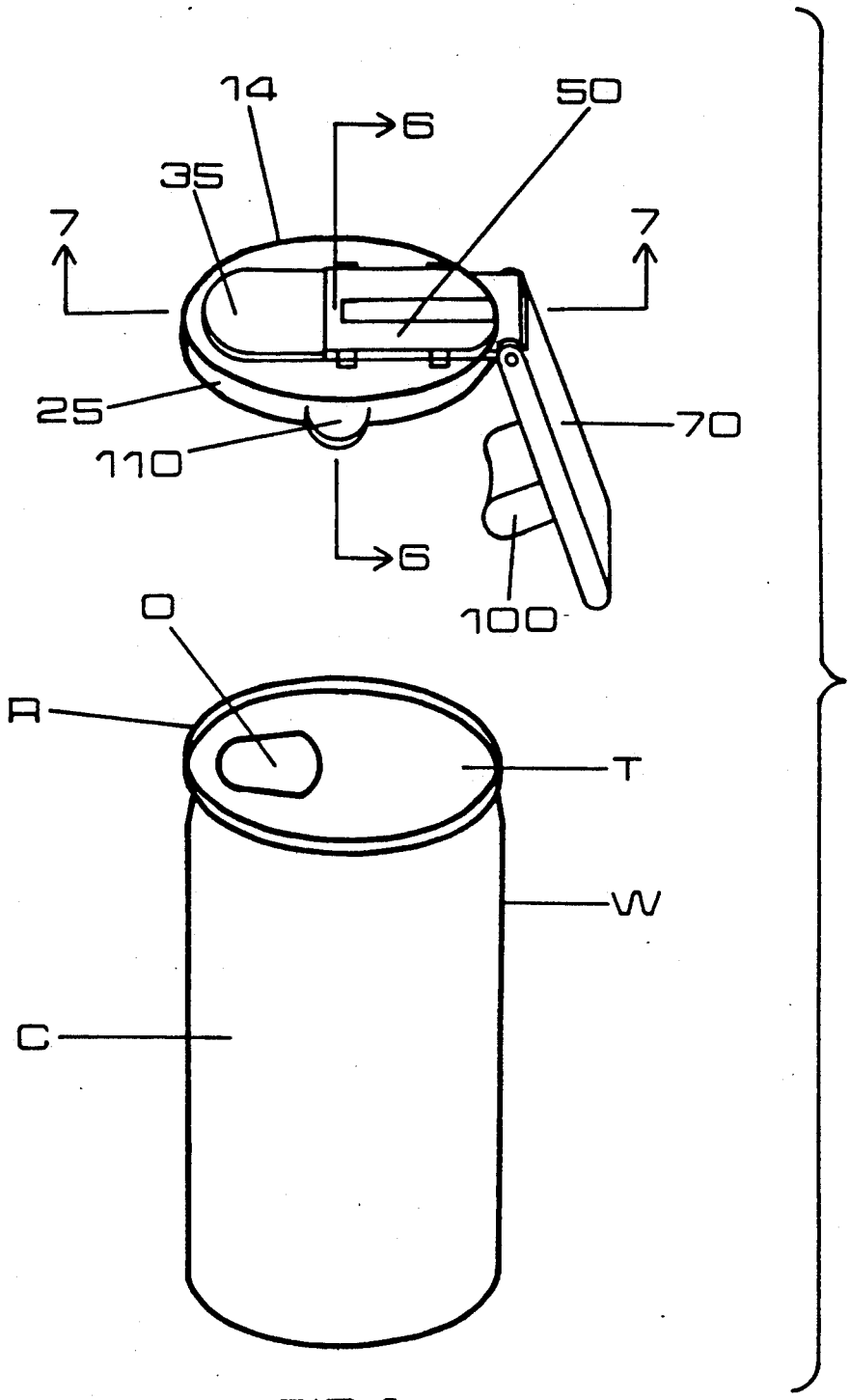
FIG. 1 is a perspective view of the subject device positioned above a container.
Figure 2:
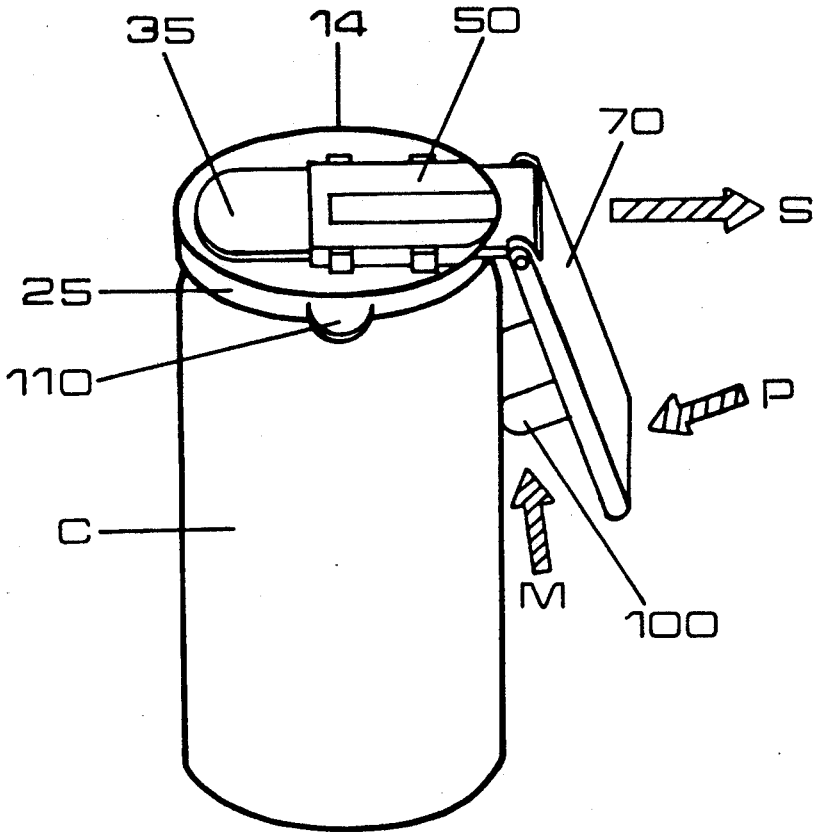
FIG. 2 is a perspective view of the subject device fitted over the top of a container.
Figure 3:
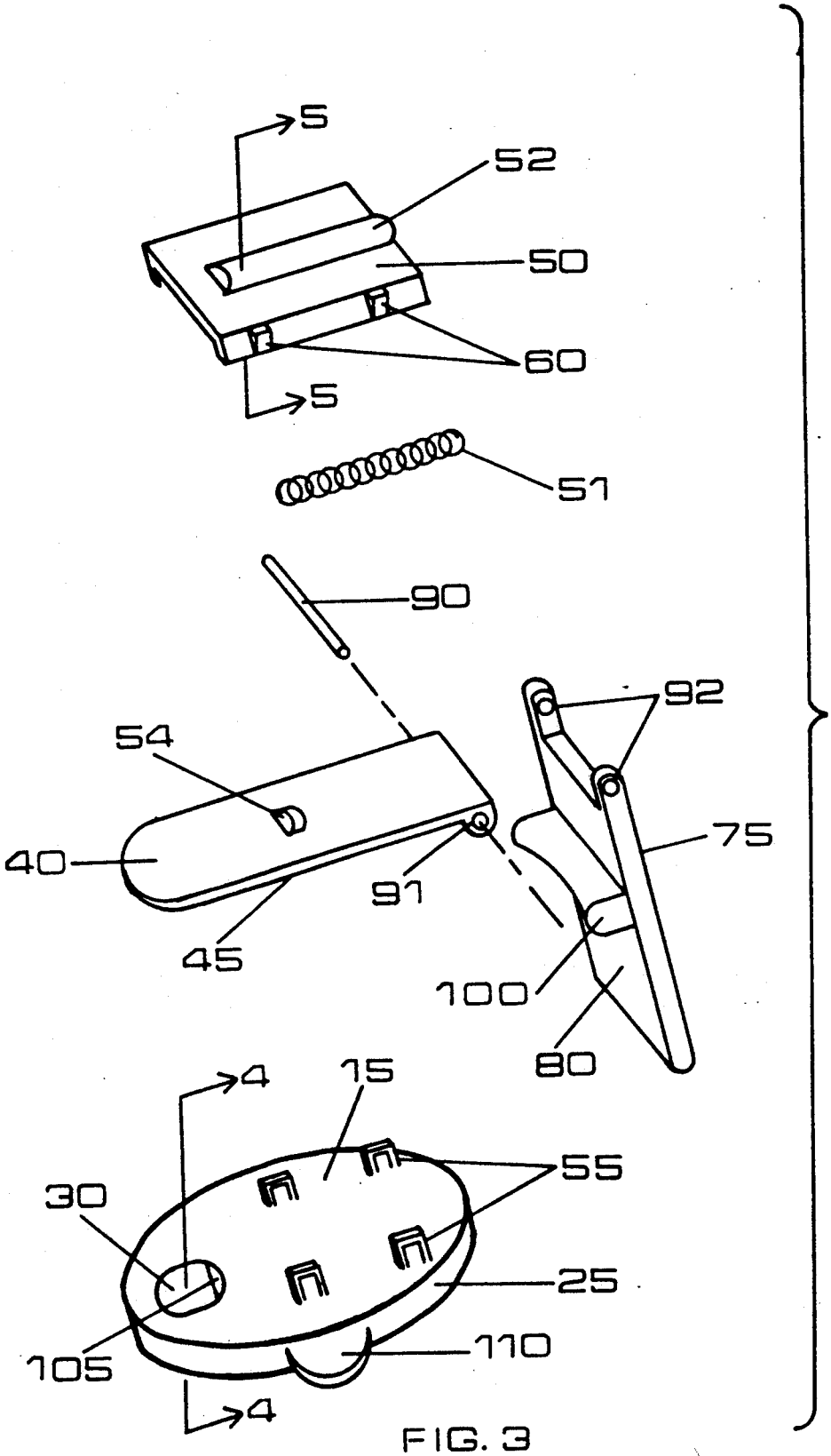
FIG. 3 is an exploded perspective view of the elements of one embodiment of the subject device.

Referring now to FIGS. 1-13, there are shown several embodiments of a self-closing container lid device of the subject invention. This device is for preventing the contents of a container from being spilled or contaminated and for maintaining the temperature of the contents of the covered container, yet providing a convenient and quick, self-sealing access means for transferring or consuming the container's contents. Any container having a top, a top opening for accessing the container's contents, and a substantially rigid outer wall surface is suitable for use with the subject invention. Preferably, the subject lid is employed with a liquid beverage container can such as ones used to hold general soft drinks such as cola and root beer, beer, juices, and the like. As seen in FIG. 1, typically, such a can C has a top T with an opening O, a rim R forming the perimeter of the top T, and a substantially rigid wall with an outer wall surface W.

The subject invention, comprises a cap 14 that has upper 15 and lower 20 surfaces and a pressure fitting and sealing perimeter lip 25 (see FIGS. 1-8). The shape and size of the cap 14 is adaptable to the dimensions of a given can top T. (It is stressed that a can will be used throughout this disclosure only as an exemplary container.) Since most cans C are cylindrical, the cap 14 is generally circular with a diameter matched to the diameter of a receiving can top T.

Penetrating through the cap 14 (passing completely through the cap upper 15 and lower 20 surfaces) is a pouring aperture 30. To facilitate drinking or pouring the container's contents the pouring aperture 30 is aligned over the container opening O.

When the subject lid is mounted on a can C (see FIG. 2), to seal the pouring aperture 30 an essentially rigid, slidable sealing plate 35 is positioned over the pouring aperture 30. The sealing plate has first and second ends and upper 40 and lower 45 surfaces, with a portion of the first end lower surface 45 directly blocking the escape of the can's contents. The sealing plate 35 slides within and is held to the cap 14 by means of a housing 50 fastened to the upper cap surface 15.

Figure 5:
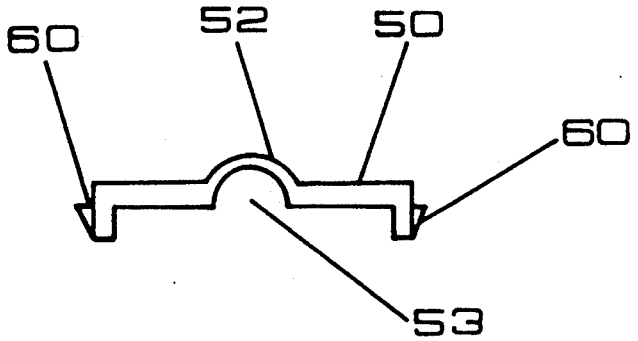
FIG. 5 is a cross sectional view of the subject housing taken along line 5—5 in FIG. 3.
Figure 6:
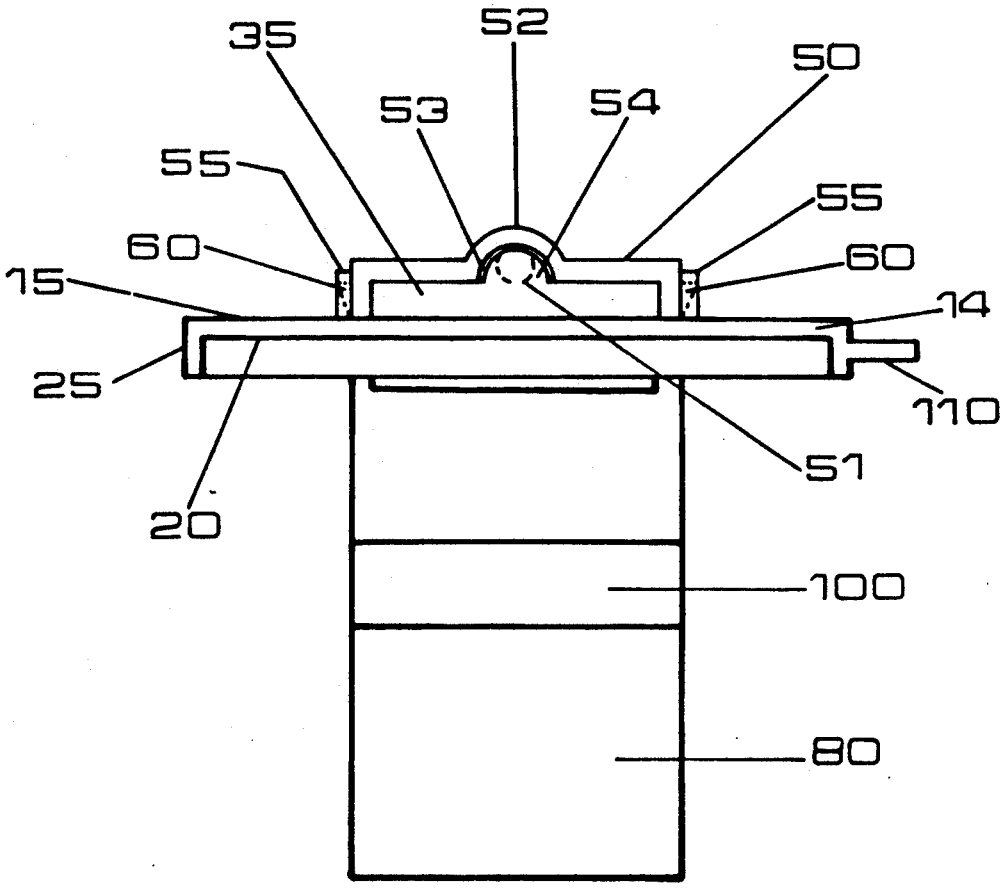
FIG. 6 is a cross sectional view of the subject device taken along line 6—6 in FIG. 1.
Figure 7:
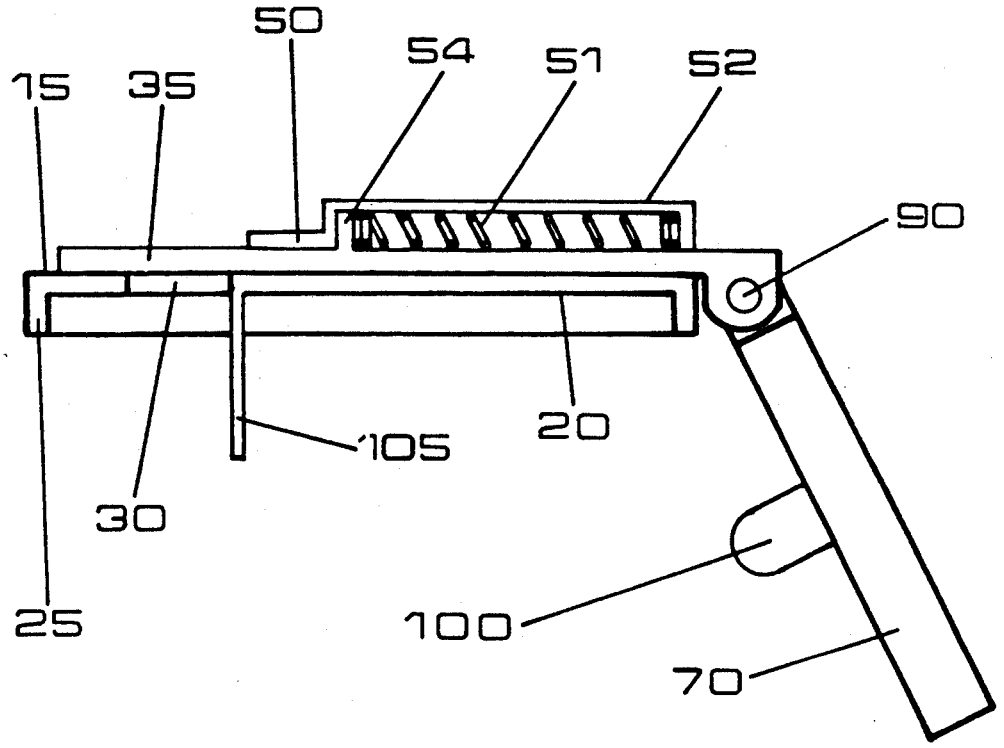
FIG. 7 is a cross sectional view of the subject device taken along line 7—7 in FIG. 1.
Figure 8:
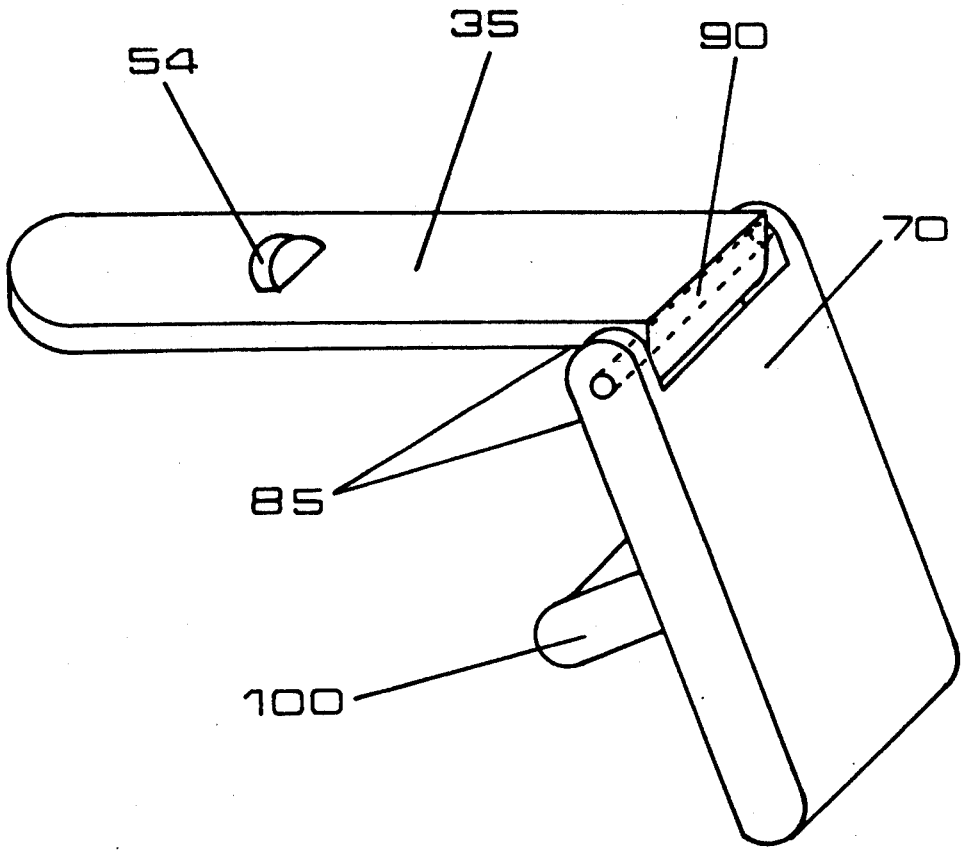
FIG. 8 is a perspective view of one embodiment of a coupled sealing plate and trigger having a pin type hinge assembly.

Leveraging means are provided for the user to uncover easily the pouring aperture 30 by applying a pressure that results in sliding the sealing plate 35, within the housing 50, into a retracted position. When the pressure is released the leveraging means automatically slides the sealing plate 35 back into a closed position over the pouring aperture 30. A resilient member provides the driving force for the return of the sliding plate 35 to a closed position. Although equivalent resilient means are contemplated to be within the realm of this disclosure, preferably, the resilient means is a spring 51 mounted within a spring enclosure 52 of the housing 50. As seen in FIGS. 5, 6, and 7, under the spring enclosure 52 is a spring compartment 53 that holds the spring 51.

The sealing plate 35 fits slidably within the housing 50. The housing 50 provides a channel in which the plate 35 slides. On the upper surface 40 of the sealing plate 35 is a spring stop 54 (see FIGS. 3, 7, 8, and 9). The spring stop 54 fits within the spring compartment 53. When the subject device is assembled (see specifically FIG. 7), the essentially expanded spring 51 fits within the spring compartment 53, above the sealing plate's upper surface 40, with one spring end proximate the spring stop 54 on the sealing plate 35 and the other spring end proximate one end of the spring compartment 53. When the leveraging means is activated the sealing plate 35 is slid within the housing 50 by the user's applied pressure to open the pouring aperture 30, the spring 51 is compressed within the spring compartment 53, under the spring enclosure 52. The energy stored in the compressed spring 51 is the driving force that automatically slides the sealing plate 35 back into the closed position, covering the pouring aperture 30, when the leveraging means is deactivated by releasing the applied pressure.

As seen in FIGS. 5 and 6, the housing 50 is secured to the cap upper surface 15 by coupling cap attachment means with housing attachment means. Various equivalent cap attachment means may be used, but usually, a cap attachment means is a member that is anchored to the cap upper surface 15 (usually part of the continuous structure of the cap 14) and projects away from the cap upper surface 15. Included in the cap attachment means is a stirrup, indentation, or female latch area 55. Mating with the female latch area 55, to secure the housing 50 in position on the cap 14, is a male latch area 60 or hook. It should be noted that the male 60 and female 55 latch areas may be switched to generate an equivalent attachment configuration. Further, although four male 60 and four female 55 latch areas are depicted, fewer or greater numbers are possible. Additionally, the means of securing the housing 50 to the cap 14 may be varied to suit the manufacturing requirements.

Figure 9:
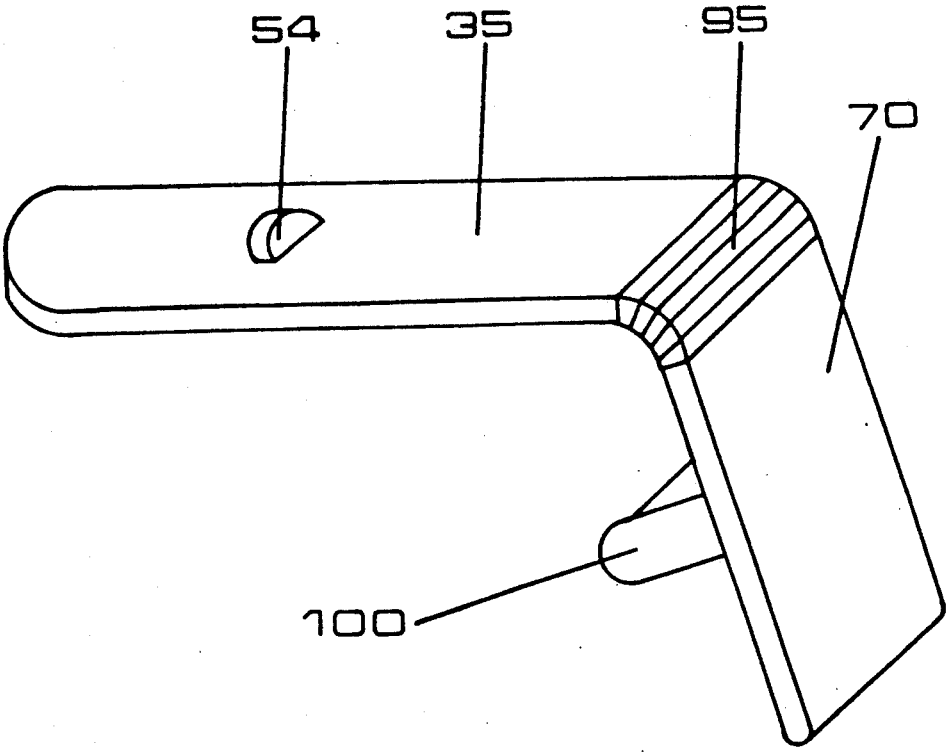
FIG. 9 is a perspective view of another embodiment of a sealing plate continuous with a trigger having a flexible hinge segment.

Comprising the leveraging means is a essentially rigid, non-flexible trigger member 70 having upper 75 and lower 80 surfaces and first and second ends. Usually, the trigger 70 is elongated and flattened and adapted to be pressed easily at the second end upper surface 75 by a finger of the user. The second end of the sealing plate 35 is connected to the trigger 70 first end by a hinge (in particular see FIGS. 8 and 9). One embodiment of a hinge 85 is depicted clearly in FIGS. 3 and 8. A hinge pin 90 secures the plate 35 to the trigger 70 by fitting within plate pin receiving holes 91 and trigger pin receiving holes 92. A second embodiment of a hinge 95 is shown in FIG. 9. To simplify the fabrication process, a continuous flexible segment 95 extends between the plate 35 second end and the trigger 70 first end. Other equivalent hinge means are within the purview of this disclosure.

Protruding outward from the trigger lower surface 80 is a leverage ridge 100. Usually, the leverage ridge 100 is of the same rigid material as the trigger 70. The leverage ridge contacts the container's outer wall surface W and provides a fulcrum that translates the user's applied pressure at the trigger 70 second end into a sliding motion of the sealing plate 35. As the user applies pressure to the trigger 70 the second end of the trigger 70 rocks towards the can's wall W while the trigger 70 first end, via the hinge, slides the plate 35 from over the pouring aperture 30. Since the plate 35 is essentially rigid, the plate 35 slides in a plane from within the housing 50. During this plate 35 withdrawal process, the leverage ridge 100 slides up (towards the top T) along the outer wall surface W (movement M in FIG. 2). When the pressure is removed from the trigger 70, the leverage ridge 100 slides down (away from the top T) along the outer wall surface W.

Figure 4:
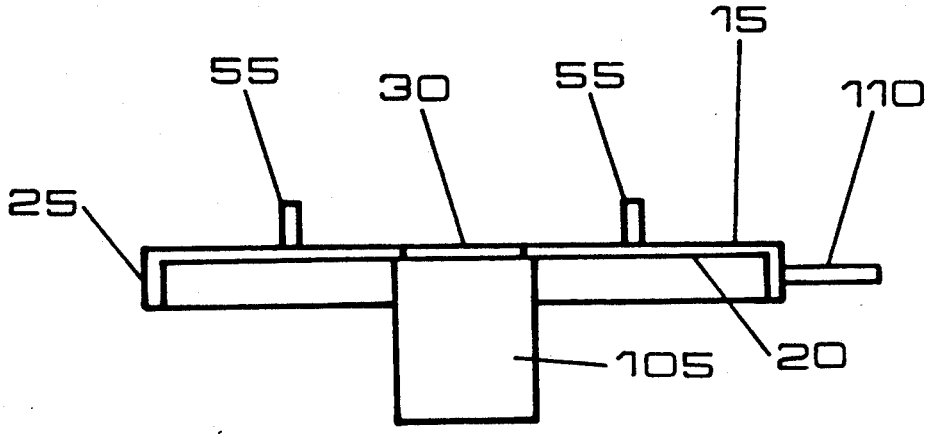
FIG. 4 is a cross sectional view of the subject cap taken along line 4—4 in FIG. 3.

To facilitate aligning the cap pouring aperture 30 over a can opening O a guide member 105 is provided (FIGS. 4 and 7 plainly illustrate the guide member 105). The guide member 105 has first and second ends, wherein the first end is fastened to the cap lower surface 20, proximate the pouring aperture 30. The exact attachment position of the guide member 105 to the cap lower surface 20 may be varied with any particular can configuration. Fitting within the can opening O is the second end of the guide member.

A tab 110 is included to assist the user in removing the lid from a container. The tab 110 projects from the sealing perimeter lip 25 and serves as a leverage point for the user.

Usually, the cap 14 is fabricated from natural or synthetic polymers, copolymers, and similar materials that provide the cap with a limited resilience or flexibility for stretching the sealing lip 25 over the can's rim R to produce a substantially liquid tight seal. The various other components are fabricated from suitable metals, woods, natural or synthetic polymers, copolymers or the like.

A user of the subject device employs the lid by first opening the container to be covered. For exemplary purposes the container is a liquid beverage can C. The lid's pouring opening is aligned over the can's opening O, preferably by means of the guide member 105, and is forced over the top T portion of the can C. The sealing lip 25 of the lid seals over and against the can's rim R. Usually, the user engages the trigger 70, at the trigger end opposite the sealing plate 35 connection area, with finger pressure P (see FIG. 2 for pressure P direction). The pressure P rocks the trigger 70 over the leverage ridge 100 at the same time the leverage ridge 100 slides up M (see FIG. 2 for leverage ridge movement M) along the container's outer wall surface W towards the can's top T, thereby sliding the hinged sealing plate 35 back from covering the pouring aperture 30 along motion arrow S. The user then pours the contents of the can C into a glass (or the like) or drinks from the pouring aperture 30. When the user intentionally or unintentionally (accidently drops or tips the can C and lid) releases the pressure P, the sealing plate 35 slides, under a force exerted by the resilient means, to the closed position, thereby blocking loss of the container's contents. Preferably, to remove the lid from the can the user forces the lid away from the container's top T by means of the tab 110 or sealing perimeter lip 25.

Figure 10:
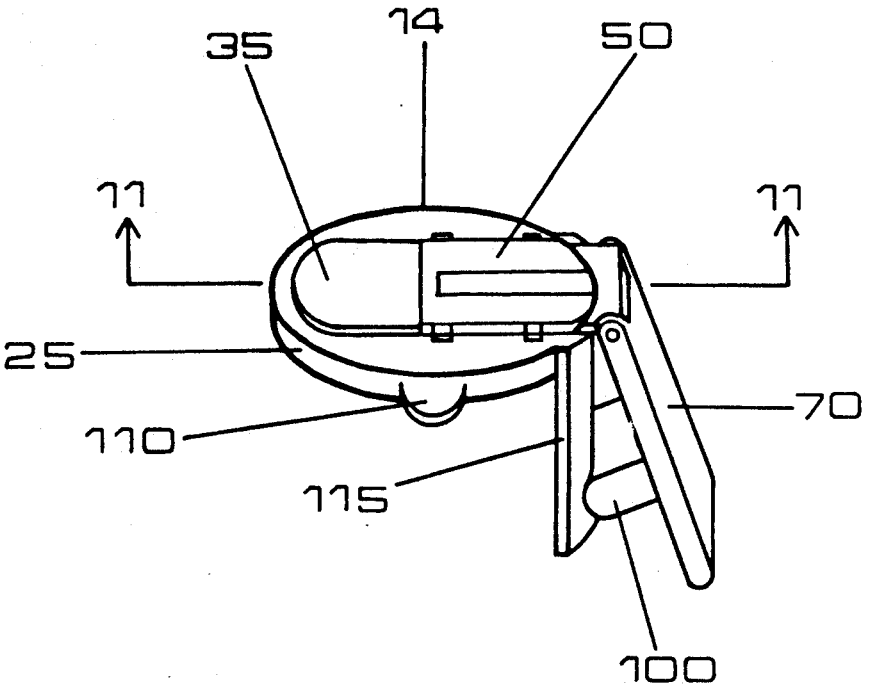
FIG. 10 is a perspective view of one alternate embodiment of the subject device.
Figure 11:
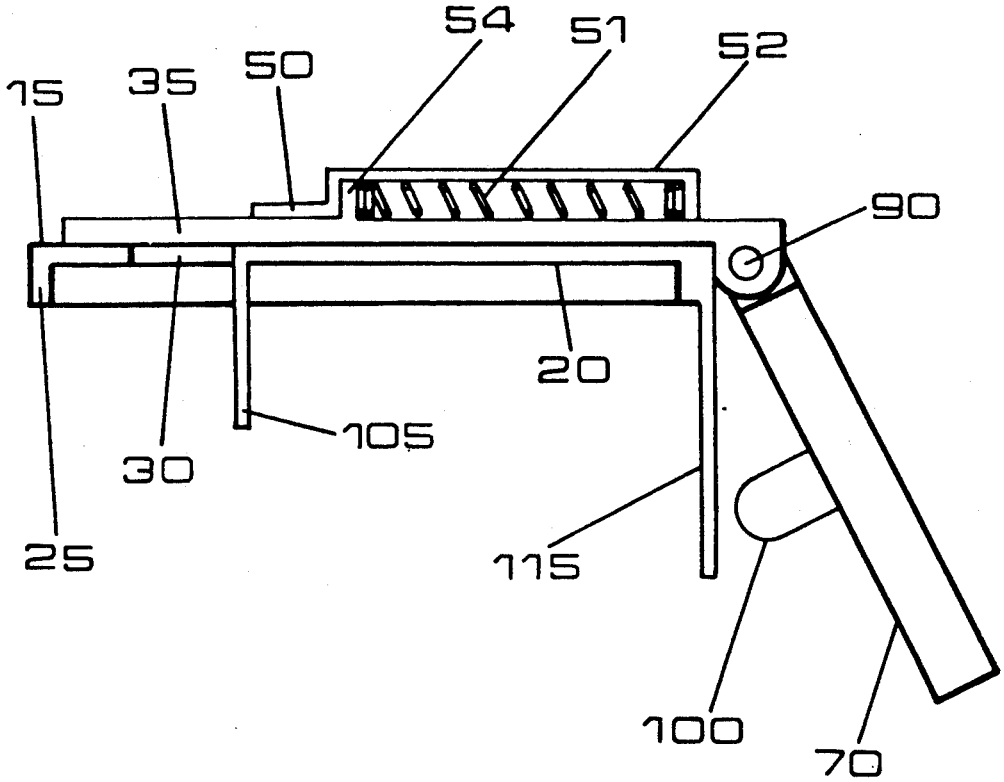
FIG. 11 is a cross sectional view of the alternate subject device shown in FIG. 10 taken along line 10—10 in FIG. 10.

As depicted in FIGS. 10 and 11, another embodiment of the subject device includes a rigid or semirigid slide plate 115 secured to the lip 25. The location of the slide plate 115 is essentially between the container's outer surface and the trigger 70. Since some containers may have an outer wall too thin or pliable to function well as a means for slidably receiving the leverage ridge 100, the slide plate 115 serves the purpose of providing a smooth surface upon which the leverage ridge 100 slides.

Figure 12:
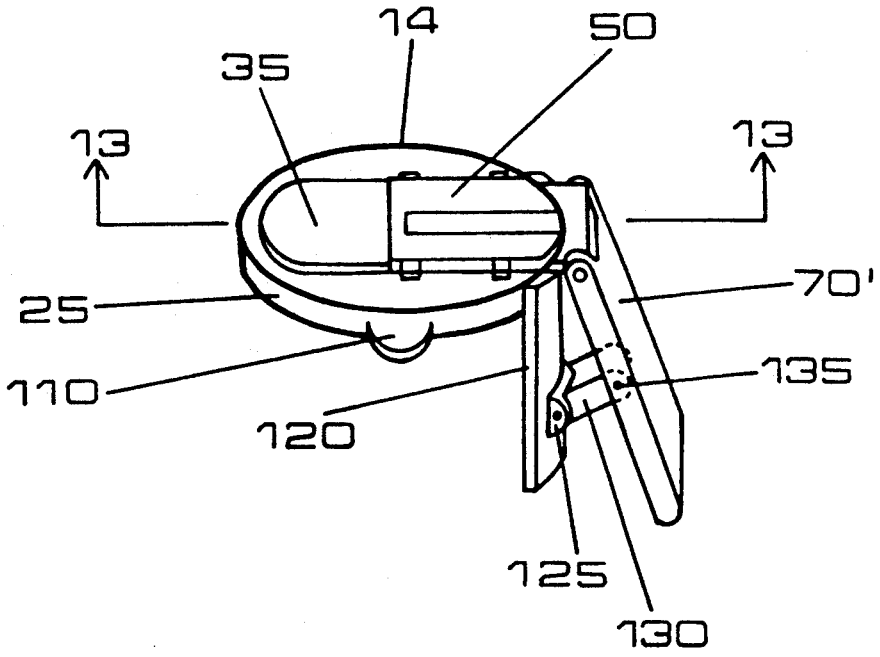
FIG. 12 is a perspective view of another embodiment of the subject device.
Figure 13:
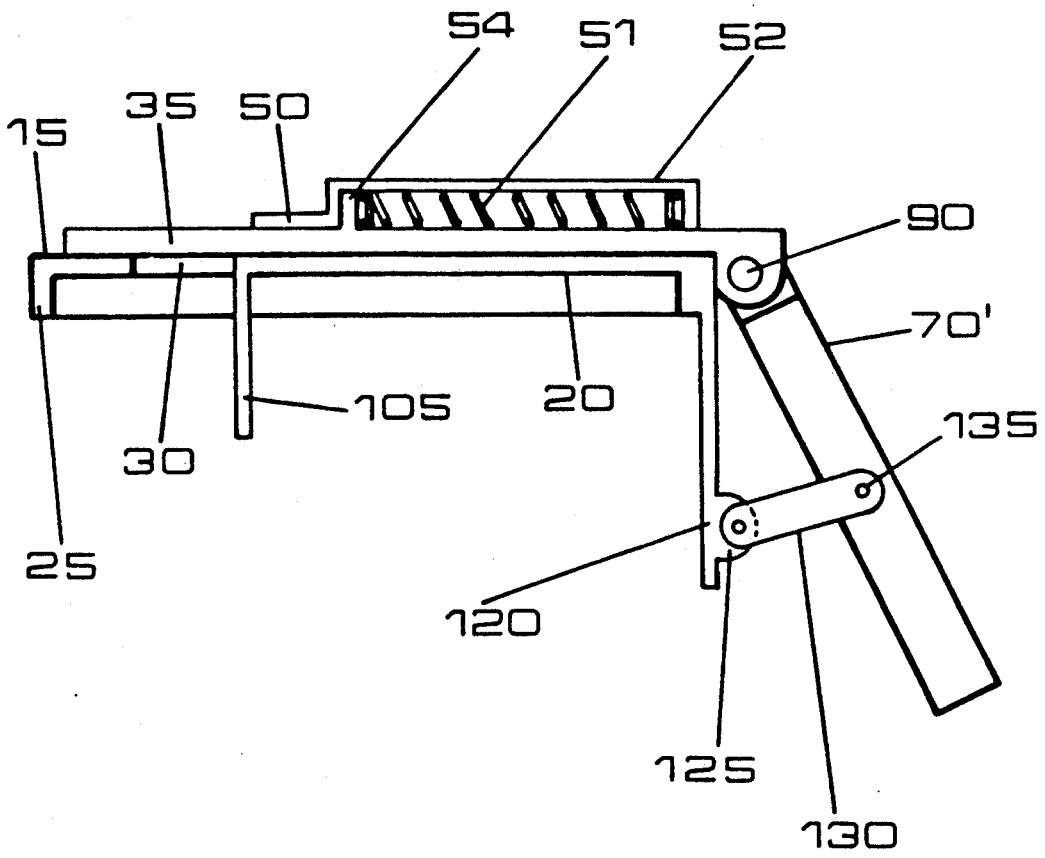
FIG. 13 is a cross sectional view of the embodiment of the subject device shown in FIG. 12 taken along line 13—13 in FIG. 12.

A further embodiment of the subject device is illustrated in FIGS. 12 and 13. In place of the combined leverage ridge 100 and either the container's outer surface or the slide plate 115 an alternate system is included. An anchor plate 120 with first and second ends is secured to the lip 25 by the first end. Proximate the second end of the anchor plate 120 is a fulcrum bar attachment means 125, usually a hinge or the like. Attached by one of its ends to the fulcrum bar attachment means 125 is a two ended fulcrum bar 130. A modified trigger 70' is included and is secured via a trigger fulcrum bar attachment means 135, usually a hinge or the like, to the other end of the fulcrum bar 130. During operation the user presses the trigger 70' along movement direction P. The sealing plate 35 withdraws along movement direction S as the fulcrum bar 130 and trigger 70' shift downward along movement direction D.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A removable self-closing lid for covering a top of a container, wherein said container has an outer wall surface and said container top has an opening for accessing into said container and a rim forming a perimeter of said top, wherein said self-closing lid comprises:

a) a cap member having upper and lower surfaces, a pressure sealing perimeter lip for securing said cap member over said top rim to produce a substantially liquid tight seal, and a pouring aperture penetrating through said cap upper and lower surfaces;

b) a sealing plate with upper and lower surfaces and having first and second ends, wherein said sealing plate is slidably positioned above said cap member upper surface and over said pouring aperture;

c) a housing fastened to said cap member upper surface in which said sealing plate slides;

d) leveraging means associated with said cap and said sealing plate for accessing said container through said pouring aperture by sliding said sealing plate within said housing and said accessing occurs when said leveraging means is activated by a user exerting pressure on said leveraging means, wherein said pressure is directed substantially towards said can, and automatically sealing said container when said leveraging means is deactivated by said user releasing said pressure, wherein said leveraging means comprises:

a trigger member with upper and lower surfaces and having first and second ends, wherein said user pressure is applied to said trigger member second end upper surface;

a hinge securing said trigger first end to said sealing plate second end;

a leverage ridge protruding from said trigger lower surface, wherein said leverage ridge provides a fulcrum during sliding of said sealing plate; and an elongated slide plate projecting from and secured to said lip, wherein said leverage ridge moves on said slide plate during leverage means activation and deactivation to produce a sliding fulcrum; and e) resilient means for automatically sealing said container, wherein said resilient means are within said housing and coupled to said sealing plate.

2. A removable self-closing lid for covering a top of a container, wherein said container has an outer wall surface and said container top has an opening for accessing into said container and a rim forming a perimeter of said top, wherein said self-closing lid comprises:

a) a cap member having upper and lower surfaces, a pressure sealing perimeter lip for securing said cap member over said top rim to produce a substantially liquid tight seal, and a pouring aperture penetrating through said cap upper and lower surfaces;

b) a sealing plate with upper and lower surfaces and having first and second ends, wherein said sealing plate is slidably positioned above said cap member upper surface and over said pouring aperture;

c) a housing fastened to said cap member upper surface in which said sealing plate slides;

d) leveraging means associated with said cap and said sealing plate for accessing said container through said pouring aperture by sliding said sealing plate within said housing and said accessing occurs when said leveraging means is activated by a user exerting pressure on said leveraging means, wherein said pressure is directed substantially towards said can, and automatically sealing said container when said leveraging means is deactivated by said user releasing said pressure, wherein said leveraging means comprises:

a trigger member with upper and lower surfaces and having first and second ends, wherein said user pressure is applied to said trigger member second end upper surface and a hinge securing said trigger first end to said sealing plate second end;

an anchor plate secured to said lip; and a fulcrum bar pivotally connected to both said anchor plate and said trigger lower surface; and e) resilient means for automatically sealing said container, wherein said resilient means are within said housing and coupled to said sealing plate.

3. A removable self-closing lid for covering a top of a liquid beverage container can, wherein said beverage container can has an outer wall surface and said can top has an opening for accessing into said liquid beverage container can and a rim forming a perimeter of said top, wherein said self-closing lid comprises:

a) a generally circular cap member having upper and lower surfaces, a generally circular pressure sealing perimeter lip for securing said cap member over said beverage container top rim to produce a substantially liquid tight seal, and a pouring aperture penetrating through said cap upper and lower surfaces;

b) a sealing plate with upper and lower surfaces and having first and second ends, wherein said sealing plate is slidably positioned above said cap member upper surface and over said pouring aperture;

c) a housing fastened to said cap member upper surface in which said sealing plate slides;

d) leveraging means associated with said cap and said sealing plate for accessing said beverage container can through said pouring aperture by sliding said sealing plate within said housing and said accessing occurs when said leveraging means is activated by a user exerting pressure on said leveraging means, wherein said pressure is directed substantially towards said can, and sealed automatically when said leveraging means is deactivated by said user releasing said pressure, wherein said leveraging means comprises:

a trigger member with upper and lower surfaces and having first and second ends, wherein said user pressure is applied to said trigger member second end upper surface and a hinge securing said trigger first end to said sealing plate second end;

a leverage ridge protruding from said trigger lower surface, wherein said leverage ridge provides a fulcrum during sliding of said sealing plate;

an elongated slide plate projecting from the secured to said lip, wherein said leverage ridge moves on said slide plate during leverage means activation and deactivation to produce a sliding fulcrum; and e) resilient means for automatically sealing said container, wherein said resilient means are located within said housing and coupled to said sealing plate.

4. A removable self-closing lid for covering a top of a liquid beverage container can, wherein said beverage container can has an outer wall surface and said can top has an opening for accessing into said liquid beverage container can and a rim forming a perimeter of said top, wherein said self-closing lid comprises:

a) a generally circular cap member having upper and lower surfaces, a generally circular pressure sealing perimeter lip for securing said cap member over said beverage container top rim to produce a substantially liquid tight seal, and a pouring aperture penetrating through said cap upper and lower surfaces;

b) a sealing plate with upper and lower surfaces and having first and second ends, wherein said sealing plate is slidably positioned above said cap member upper surface and over said pouring aperture;

c) a housing fastened to said cap member upper surface in which said sealing plate slides;

d) leveraging means associated with said cap and said sealing plate for accessing said beverage container can through said pouring aperture by sliding said sealing plate within said housing and said accessing occurs when said leveraging means is activated by a user exerting pressure on said leveraging means, wherein said pressure is directed substantially towards said can, and sealed automatically when said leveraging means is deactivated by said user releasing said pressure, wherein said leveraging means comprises:

a trigger member with upper and lower surfaces and having first and second ends, wherein said user pressure is applied to said trigger member second end upper surface and a hinge securing said trigger first end to said sealing plate second end;

an anchor plate secured to said lip; and a fulcrum bar pivotally connected to both said anchor plate and said trigger lower surface; and e) resilient means for automatically sealing said container, wherein said resilient means are located within said housing and coupled to said sealing plate.

5. A removable self-closing lid for covering a top of a container, wherein said container has an outer wall surface and said container top has an opening for accessing into said container and a rim forming a perimeter of said top, wherein said self-closing lid comprises:

a) a cap member having upper and lower surfaces, a pressure sealing perimeter lip for securing said cap member over said top rim to produce a substantially liquid tight seal, and a pouring aperture penetrating through said cap upper and lower surfaces;

b) a sealing plate with upper and lower surfaces and having first and second ends, wherein said sealing plate is slidably positioned above said cap member upper surface and over said pouring aperture;

c) a housing fastened to said cap member upper surface in which said sealing plate slides;

d) leveraging means associated with said cap and said sealing plate for accessing said container through said pouring aperture by sliding said sealing plate within said housing and said accessing occurs when said leveraging means is activated by a user exerting pressure on said leveraging means, wherein said pressure is directed substantially towards said can, and automatically sealing said container when said leveraging means is deactivated by said user releasing said pressure, wherein said leveraging means comprises:

a trigger member with upper and lower surfaces and having first and second ends, wherein said user pressure is applied to said trigger member second end upper surface;

a sliding leverage ridge protruding from said trigger lower surface, wherein said sliding leverage ridge provides a fulcrum during sliding of said sealing plate, wherein said leverage ridge slides on said outer container wall surface during leverage means activation and deactivation to produce a sliding fulcrum; and a hinge securing said trigger first end to said sealing plate second end; and e) resilient means for automatically sealing said container, wherein said resilient means are within said housing and coupled to said sealing plate.

6. A removable self-closing lid for covering a top of a liquid beverage container can, wherein said beverage container can has an outer wall surface and said can top has an opening for accessing into said liquid beverage container can and a rim forming a perimeter of said top, wherein said self-closing lid comprises:

a) a generally circular cap member having upper and lower surfaces, a generally circular pressure sealing perimeter lip for securing said cap member over said beverage container top rim to produce a substantially liquid tight seal, and a pouring aperture penetrating through said cap upper and lower surfaces;

b) a sealing plate with upper and lower surfaces and having first and second ends, wherein said sealing plate is slidably positioned above said cap member upper surface and over said pouring aperture;

c) a housing fastened to said cap member upper surface in which said sealing plate slides;

d) leveraging means associated with said cap and said sealing plate for accessing said beverage container can through said pouring aperture by sliding said sealing plate within said housing and said accessing occurs when said leveraging means is activated by a user exerting pressure on said leveraging means, wherein said pressure is directed substantially towards said can, and sealed automatically when said leveraging means is deactivated by said user releasing said pressure, wherein said leveraging means comprises:

a trigger member with upper and lower surfaces and having first and second ends, wherein said user pressure is applied to said trigger member second end upper surface;

a sliding leverage ridge protruding from said trigger lower surface, wherein said sliding leverage ridge provides a fulcrum during sliding of said sealing plate, wherein said leverage ridge slides on said outer container wall surface during leverage means activation and deactivation to produce a sliding fulcrum; and a hinge securing said trigger first end to said sealing plate second end; and e) resilient means for automatically sealing said container, wherein said resilient means are located within said housing and coupled to said sealing plate.

* * * * *